United States Patent [19]

Propst

[11] 4,153,313

[45] May 8, 1979

[54] STORAGE LOCKER

[75] Inventor: Robert L. Propst, Ann Arbor, Mich.

[73] Assignee: Herman Miller, Inc., Zeeland, Mich.

[21] Appl. No.: 903,247

[22] Filed: May 5, 1978

[51] Int. Cl.[2] ..... A47B 81/00; A47G 91/00

[52] U.S. Cl. ..... 312/211; 220/306; 232/43.1; 312/257 A

[58] Field of Search ..... 312/245, 109, 292, 257, 312/211; 220/306, 329, 340; 232/43.1, 43.2, 43.4, 43.5

[56] References Cited

U.S. PATENT DOCUMENTS

| | | | |
|---|---|---|---|
| 826,292 | 7/1906 | Truxall | 220/306 |
| 3,238,004 | 3/1966 | Goebel | 312/330 |
| 3,853,237 | 12/1974 | Marchant | 220/306 |
| 4,027,775 | 6/1977 | Mygatt, Jr. et al. | 220/306 |

*Primary Examiner*—Mervin Stein
*Assistant Examiner*—Alex Grosz
*Attorney, Agent, or Firm*—Olsen and Stephenson

[57] ABSTRACT

A wall mounted storage locker comprising an upright hollow body having rear, side, top, and bottom walls, and upper and lower front wall panels that are removably mounted on the body. Each of the front wall panels has side flanges which overlap the body side walls and are spring urged by the resiliency of the panel material toward the side walls. Coacting stop shoulders are formed on portions of the panels and on the body side walls, the shoulders being engageable in positions of the panel flanges sprung toward the side walls, so as to releasably retain the panels on the body.

10 Claims, 7 Drawing Figures

Fig-4
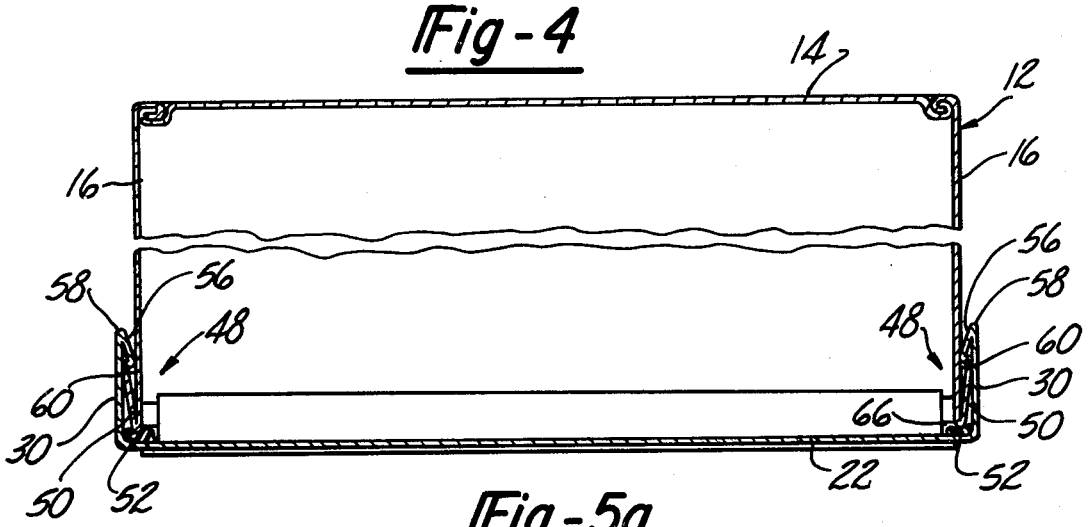
Fig-5a
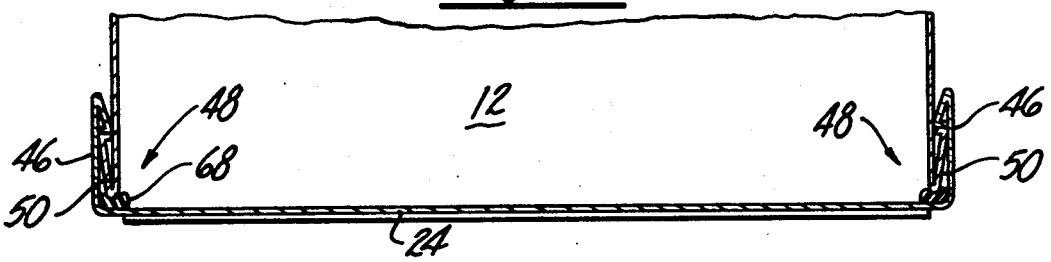
Fig-5b
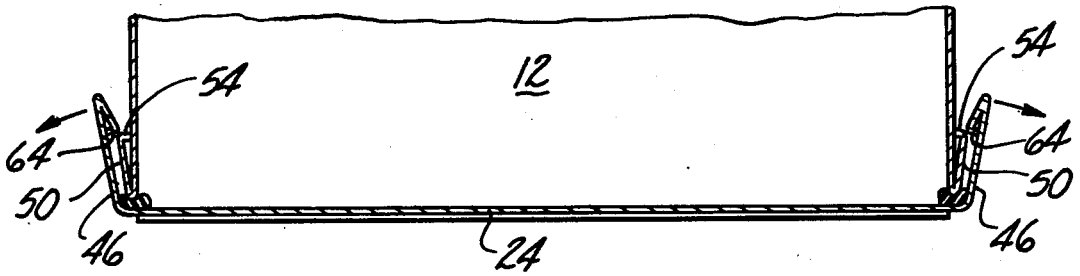
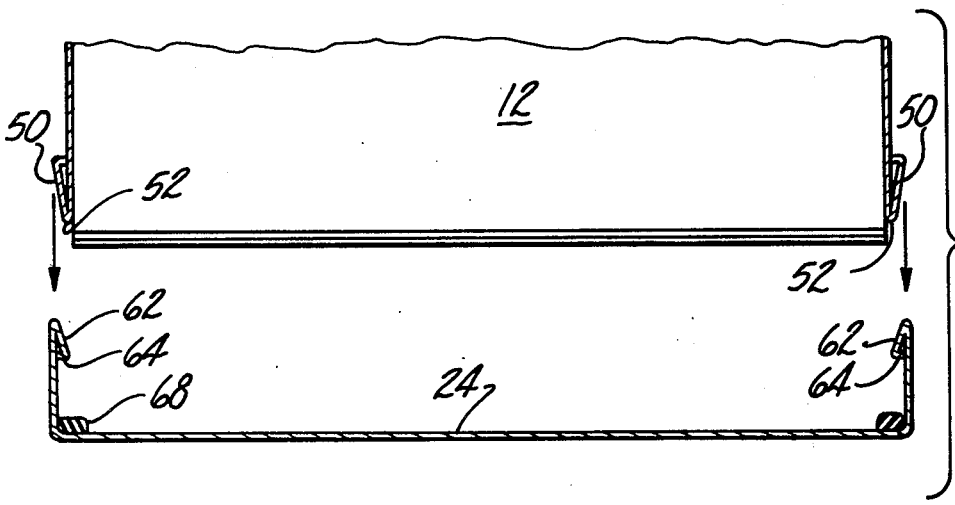
Fig-5c

STORAGE LOCKER

BACKGROUND OF THE INVENTION

This invention relates generally to storage lockers which can be readily filled, readily emptied, and easily cleaned. Prior storage lockers attempting to meet these objectives have been unsatisfactory either from the standpoint of performance, or cost of installation and maintenance. The principal object of this invention, therefore, is to provide an improved storage locker of this type.

SUMMARY OF THE INVENTION

The storage locker of this invention comprises an upright hollow body having a rear wall, side walls, a top wall, and a bottom wall. A first front wall panel is suspended from the upper end of the body and is engaged with the body side walls. This panel has an inlet opening for the locker and a hinged door is pivotally mounted on the panel so as to close the opening. A second front wall panel is supported on the body bottom wall and extends upwardly therefrom to a position at the lower end of the first front wall panel so that the two panels cooperate to enclose the front end of the storage locker.

The bottom panel likewise has side flanges which overlap the body side walls and this panel is also formed of a yieldable material which enables the flanges to be sprung apart and to then spring toward each other and into engagement with the body side walls. Rearwardly facing shoulders are provided on the body side walls and forwardly inclined cam surfaces extend between the shoulders and the front edges of the side walls. These shoulders are located at the lower end of the upper panel and the upper end of the lower panel and these portions of the panels are provided with similar shoulders and inclined cam surfaces which are reversely arranged relative to those that are on the body side walls. This structure enables the panel side flanges to be snapped over the shoulders on the body side walls so that the shoulders on the side walls and the shoulders on the flanges coact to releasably lock the front wall panels on the body.

This arrangement enables ready removal of the lower panel for emptying of the locker contents and ready removal of both panels for cleaning of the interior of the locker. These desirable objectives are readily accomplished at a minimum of cost by virtue of the simplicity of the mounting and locking of the locker front panels on the locker body.

Further objects, features, and advantages of this invention will become apparent from a consideration of the following description and the appended claims when taken in connection with the accompanying drawing in which:

FIG. 4 is a foreshortened horizontal sectional view of the storage locker of this invention, showing the upper one of the front wall panels mounted on the locker body;

FIG. 5A is a fragmentary horizontal sectional view of a portion of the storage locker of this invention showing the lower one of the front wall panels mounted on the locker body; and FIG. 5B is a sectional view like FIG. 5A showing the side flanges on the front wall panel sprung apart preparatory to removing the panel from the locker body; and FIG. 5C is a view like FIGS. 5A and 5B showing the front wall panel being moved away from the locker body.

Figure 1:
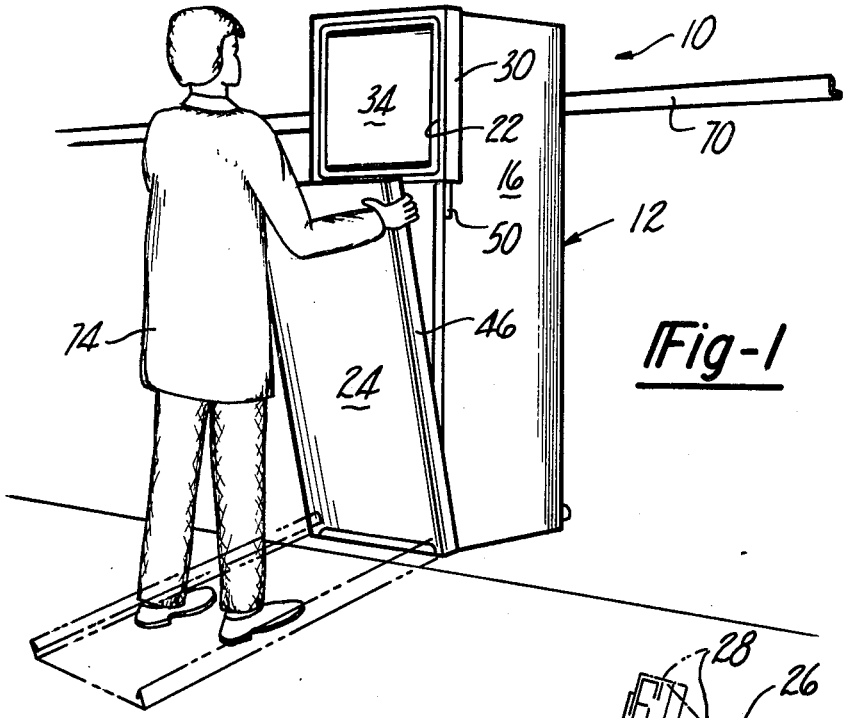
FIG. 1 is a perspective view of the storage locker of this invention illustrating the lower front panel in position being removed from the locker in solid lines and in a floor supported position in broken lines.
Figure 2:
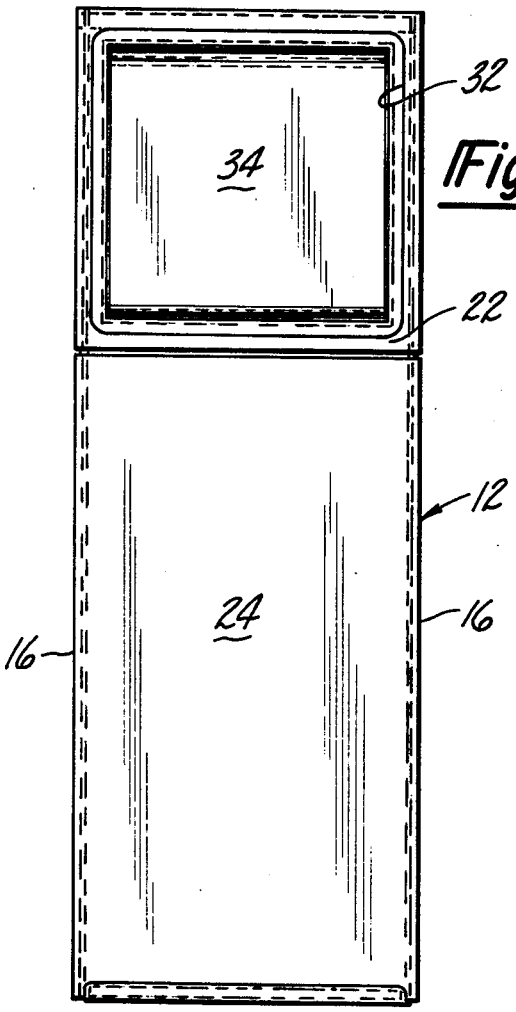
FIG. 2 is a front elevational view of the storage locker of this invention.
Figure 3:
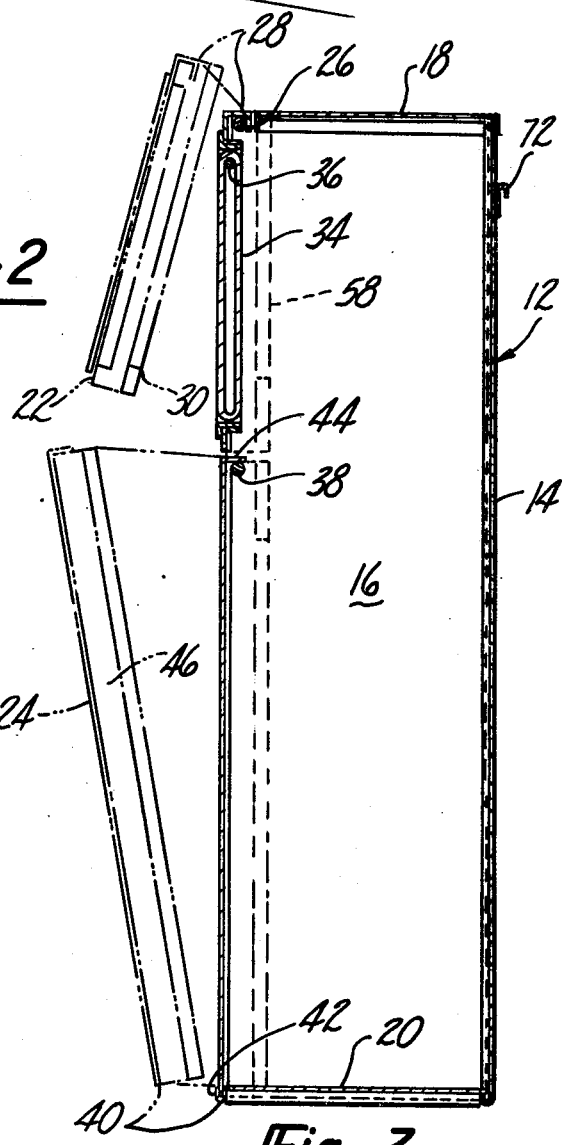
FIG. 3 is a side elevational view of the storage locker of this invention illustrating the front panels in positions being removed from the locker in broken lines.

With reference to the drawing, the storage locker of this invention, indicated generally at 10, is illustrated in FIGS. 1, 2, and 3 as consisting of an upright hollow body 12 of generally boxlike shape having a rear wall 14, side walls 16, a top wall 18, and a bottom wall 20. A pair of front wall panels, namely, an upper panel 22 and a lower panel 24 are provided for closing the front end of the body 12.

As shown in FIG. 3, a support bar 26 is mounted on the body 12 at a position forwardly of the top wall 18. The front wall panel 22 is provided at its upper end with a hook-shape section 28 which is supported on the bar 26 so as to suspend the front wall panel 22 from the bar 26. The front wall panel 22 has rearwardly extending side flanges 30 which overlap the body side walls 16 as shown in FIG. 4. The panel 22 is also provided with a large rectangular opening 32 which functions as the inlet opening for the locker 10. A rectangular door 34 is suspended on a hinge pin 36 carried by the panel 22 so that the door 34 normally hangs in a position closing the opening 32. The door 34 is readily swung into the body 12 when it is desired to deposit material in body 12 for storage purposes.

The lower panel 24 extends between the bottom wall 20 and a brace 38 which is connected to and extends between the side walls 16 at a position adjacent the lower end of the panel 22. The lower edge 40 of the panel 24 is positioned within a generally U-shape support channel 42 formed on the forward edge of the bottom wall 20 and a flange 44 on the upper end of the panel 24 extends over the brace 38. As shown in FIG. 3, the panels 22 and 24 cooperate, when installed on the body 12, to close the front end thereof. The panel 24 also has rearwardly extending side flanges 46 which overlap the body side walls 16 as shown in FIG. 5A.

To enable ready and efficient mounting and removal of the panels 22 and 24 on the body 12, the body side walls 16 and the panel side flanges 30 and 46 are provided with coacting stop assemblies 48 which best appear in FIGS. 4 and 5. The assemblies 48 consist of rearwardly and outwardly inclined cam walls 50 which extend rearwardly from the front edges 52 of the body side walls 16 at positions intermediate the upper and lower ends thereof. The cam walls 50 are located horizontally opposite the lower end of the upper panel 22 and the upper end of the lower panel 24. Each of the cam walls 50 terminates in a rearwardly facing shoulder 54 engaged with a side wall 16.

Each of the upper panel side flanges 30 is provided with a forwardly and inwardly inclined cam wall 56 which extends forwardly from the rear edge 58 of the flange 30. Each of the walls 56 terminates at its inner end in a forwardly facing shoulder 60 of a size comparable to the size of a side wall shoulder 54.

Each of the lower panel side flanges 46 is similarly formed with a forwardly and inwardly inclined cam wall 62 which terminates at its inner end in a forwardly facing shoulder 64. Thus, in the mounted positions of the panels 22 and 24, the panel shoulders 60 and 64 engage the side wall shoulders 54 so as to positively retain the panels 22 and 24 on the body 12. Sealing gaskets 66 and 68 are mounted on the panels 22 and 24, respectively, at positions engageable with the front edges 52 of the side walls 16 so as to provide for a dust-tight mounting of the panels 22 and 24 on the body 12.

In use, the locker 10 is normally hung on a wall mounted rail 70 by hooking a hanger 72 on the rear wall 14 over the rail 70 as shown in FIG. 1. The locker 10 is filled by pushing the door 34 inwardly and dropping material, such as soiled linen or other similar waste material normally generated in a hospital or similar facility, into the body 12. Now assume that the body 12 is filled and it is desired to empty the body 12. The side flanges 46 on the lower panel 24 are manually grasped at positions adjacent the upper end of the panel 24 as the individual shown at 74 in FIG. 1 is doing. The panels 22 and 24 are formed of a light gage metal or equivalent plastic material with sufficient resilience to enable the side flanges 46 to be sprung outwardly away from each other, as illustrated in FIG. 5B, to positions in which the shoulders 64 are clear of the shoulders 54. The panel 24 can then be moved away from the body 12 as shown in FIG. 5C and can then be swung outwardly and downwardly to the downwardly inclined position shown in broken lines in FIG. 1 in which the panel 24 will act as a slide to facilitate unloading of material from the body 12.

To re-install the panel 24, the lower edge 40 thereof is positioned in the channel 42, and the upper end of the panel 24 is moved rearwardly to engage the cam walls 62 with the inclined cam walls 50 on the body side walls 16. Further rearward movement of the panel 24 causes the walls 62 to ride outwardly on the walls 50 thereby forcing the side flanges 46 to spring outwardly as shown in FIG. 5B until the shoulders 64 have been moved to positions rearwardly of the shoulders 54. The inherent resiliency in the panel 24 then causes the side flanges 46 to spring inwardly into engagement with the side walls 16 in position in which the shoulders 64 are behind the shoulders 54. In this position of the panel 24, engagement of the shoulders 64 with the shoulders 54 positively locks the lower panel 24 on the body 12.

In the event removal of both panels 22 and 24 is desired, such as for the purpose of cleaning the interior of the body 12, the lower panel 24 is removed as heretofore described and the upper panel 22 is removed in the same manner. The lower ends of the side flanges 30 are first manually grasped and moved in directions away from each other to clear the shoulders 60 from the shoulders 54. The lower end of the panel 22 is then swung forwardly to the position shown in broken lines in FIG. 1 and the panel 22 is moved upwardly to move the hook section 28 off the bar 26. The entire interior of the body 12 is then totally accessible for cleaning purposes.

The lower panel 24 is re-installed as heretofore described and the upper panel 22 is mounted on the body 12 by first hooking the section 28 over the bar 26 and then swinging the panel 22 downwardly and rearwardly to engage the cam walls 50 and 56 so that further rearward movement of the panel 22 will cause the side flanges 30 to snap into positions in which the shoulders 60 are behind the shoulders 54.

From the above description, it is seen that this invention provides an improved storage locker 10 with removable front wall panels 22 and 24 to facilitate discharge of the locker contents and cleaning of the locker interior.

What is claimed is:

1. A storage locker comprising an upright hollow body having a rear wall, side walls, a top wall and a bottom wall, a plurality of front wall panels removably mounted on said body in a vertical arrangement, each of said front wall panels being mounted on and removable from said body independent of the remaining ones of said front wall panels, an upper one of said front wall panels having an inlet opening enabling articles to be deposited in said storage locker, means on said body supportingly engaged with each of said panels so as to support said panels against vertical movement on said body, each of said panels having side flanges overlapping said body side walls and spring urged toward said side walls, and coacting stop means on said flanges and said side walls engageable in positions of said flanges sprung toward each other so as to retain said panels on said body.

2. A storage locker according to claim 1 wherein said coacting stop means comprises rearwardly facing shoulders on said side walls and forwardly facing shoulders on said side flanges engaged with said side wall shoulders.

3. A storage locker according to claim 2 wherein said side flanges are provided with forwardly and inwardly inclined cam surfaces terminating at said shoulders and said side walls are similarly provided with rearwardly and outwardly inclined cam surfaces which terminate at said side wall shoulders and are engageable with said flange cam surfaces during mounting of said panels on said body to facilitate movement of said flange shoulders to positions rearwardly of said side wall shoulders.

4. A storage locker according to claim 3 wherein said plurality of panels includes an upper panel and a lower panel, means at the top of said body supporting said upper panel thereon, and means at the lower end of said body supporting said lower panel thereon.

5. A storage locker comprising an upright hollow body having a rear wall, side walls, a top wall and a bottom wall, a plurality of front wall panels including an upper panel and a lower panel removably mounted on said body, means at the top of said body supporting said upper panel thereon, means at the lower end of said body supporting said lower panel thereon, means on said body supportingly engaged with each of said panels so as to support said panels against vertical movement on said body, means forming an inlet opening in said upper panel, a door for said inlet opening, means on said upper panel pivotally supporting said door for movement between open and closed positions relative to said opening, each of said panels having side flanges overlapping said body side walls and spring urged toward side walls, said side flanges being provided with forwardly and inwardly inclined cam surfaces terminating at said shoulders and said side walls being similarly provided with rearwardly and outwardly inclined cam surfaces which terminate at said side wall shoulders and which are engageable with said flange cam surfaces during mounting of said panels on said body to facilitate movement of said flange shoulders to positions rearwardly of said side wall shoulders, and coacting stop means on said flange and said side walls engageable in positions of said flanges sprung toward each other so as to retain said panels on said body, said coacting stop means comprising rearwardly facing shoulders on said side walls and forwardly facing shoulders on said side flanges engaged with said side wall shoulders.

6. A storage locker according to claim 5 further including hanger means on said rear wall enabling hanging of said locker on a fixed support.

7. A storage locker comprising an upright body having a rear wall, side walls, a top wall and a bottom wall, a support member on said body located forwardly of and adjacent said top wall, a first front wall panel suspended from said support member and engaged with said side walls, said first panel having an inlet opening for said locker therein and terminating at the lower end thereof in a spaced relation with said bottom wall, a second front wall panel supported on said body and engaged with said side walls, said second panel extending from the lower end of said first panel to said bottom wall, each of said panels having side flanges overlapping said locker side walls, said panels being formed of a yieldable material enabling springing movement of said flanges toward and away from each other and toward and away from said side walls, and coacting stop means on said flanges and said side walls engageable in positions of said flanges sprung toward each other so as to retain said panels on said body.

8. A storage locker according to claim 7 wherein said coacting stop means comprises means forming forwardly facing shoulders on said panel flanges and means forming corresponding rearwardly facing shoulders on said side walls.

9. A storage locker according to claim 8 wherein said shoulders are located at the bottom end of said first panel and at the upper end of said second panel.

10. A storage locker according to claim 7 further including flange means on said bottom wall supporting said second panel on said body.

* * * * *